United States Patent [19]

Remington

[11] 3,980,067

[45] Sept. 14, 1976

[54] PRIMER VALVE FOR MODEL ENGINES

[76] Inventor: Richard C. Remington, 10 Van Riper Ave., Pompton Plains, N.J. 07444

[22] Filed: Feb. 21, 1975

[21] Appl. No.: 551,601

[52] U.S. Cl. ..... 123/187.5 R; 123/145 R; 123/169 V; 123/187.5 P; 123/DIG. 3

[51] Int. Cl.[2] ..... F02M 1/16

[58] Field of Search ..... 123/32 SJ, 145 R, 169 V, 123/179 H, 179 AS, 185 D, 187.5 R, 187.5 P, 73 C, 73 PB, 148 A, 182, 145 A, 146, DIG. 3

[56] References Cited

UNITED STATES PATENTS

| | | | |
|---|---|---|---|
| 1,098,214 | 5/1914 | Beam | 123/187.5 P |
| 1,223,124 | 4/1917 | Thompson | 123/32 SJ |
| 1,226,191 | 5/1917 | Creamer | 123/169 V |
| 1,347,035 | 7/1920 | Hendron | 123/187.5 P |
| 2,672,546 | 3/1954 | Klingher et al. | 123/145 R |
| 2,811,149 | 10/1957 | Tirloni | 123/75 B |
| 3,040,722 | 6/1962 | Phillips | 123/75 B |

*Primary Examiner*—Wendell E. Burns
*Assistant Examiner*—David D. Reynolds

[57] ABSTRACT

A primer valve for a 2-cycle model engine attached to an accessible portion of the engine to facilitate starting thereof. The valve is provided with direct access to the engine cylinder and with a check valve responsive to the continuous positive internal pressure of the operating engine. A squeeze container is utilized to send a small charge of fuel through the valve into the cylinder.

2 Claims, 3 Drawing Figures

PRIMER VALVE FOR MODEL ENGINES

BACKGROUND OF THE INVENTION

1. The Field of the Invention

The present invention relates to a primer valve and more particularly to a primer valve adapted to be attached to an accessible portion of a two-cycle model engine to facilitate the injection of a small change of fuel into the cylinder during the starting procedure.

2. Description of the Prior Art

Present noise pollution controls require the use of a muffler on two-cycle model engines which makes the exhaust port inaccessible. Therefore, the usual starting procedure of priming the engine through the exhaust port is limited to those mufflers provided with a priming aperture. In engines equipped with mufflers that do not have priming apertures, the engine must be primed through the carburetor which results in difficult engine starts. In general, priming apertures found in the prior art are not always in an accessible position depending on the mounting configuration of the engine or cowling and because it is necessary to have the engine piston in the down position to prime through the exhaust port.

SUMMARY OF THE INVENTION

It is, therefore, an object of the present invention to provide direct priming of a two-cycle model engine which is independent of the mounting configuration of the engine.

It is a further object of the present invention to provide a primer valve for model engines of the above type which is automatically closed after priming the engine. Toward the fulfillment of these objects, the primer valve of the present invention comprises a valve which permits flow in only one direction and means for mounting the valve without modification of the engine structure.

BRIEF DESCRIPTION OF THE DRAWINGS

Reference is now made to the accompanying drawings for a better understanding of the nature and objects of the present invention. The drawings illustrate the best mode presently contemplated for carrying out the objects of the invention and are not to be construed as restrictions or limitations on its scope. In the drawings.

DESCRIPTION OF THE PREFERRED EMBODIMENTS

Figure 1:
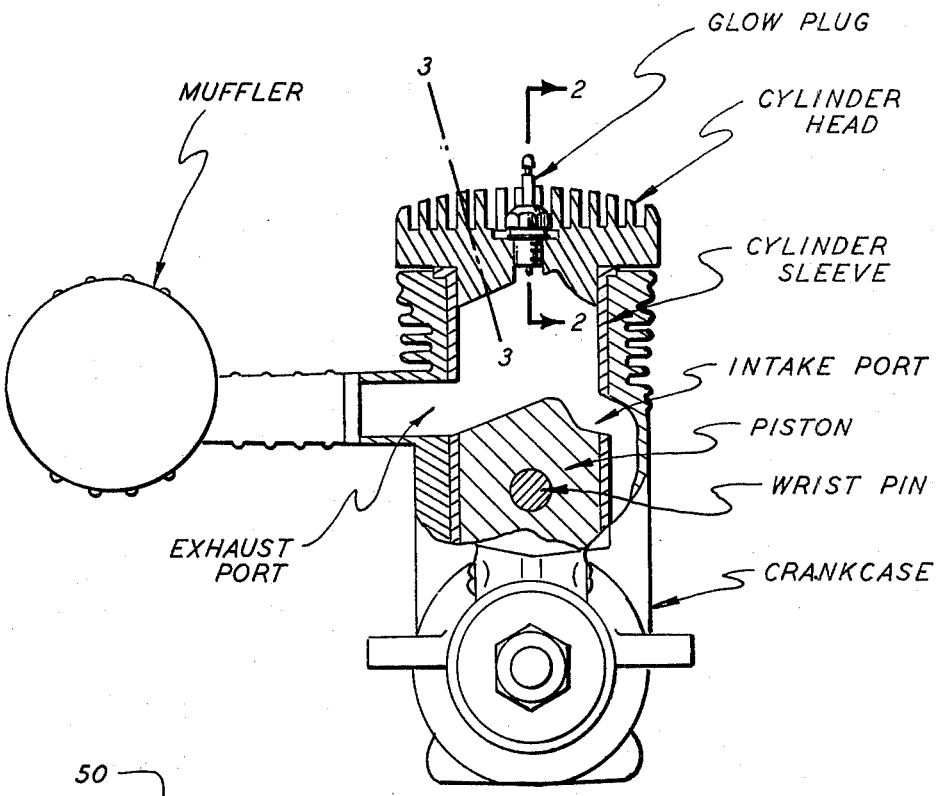
FIG. 1 is a side view of a two-cycle model engine partly in cross-section showing the combustion chamber with the glow plug incorporating the primer valve in accordance with a preferred embodiment of the invention.
Figure 2:
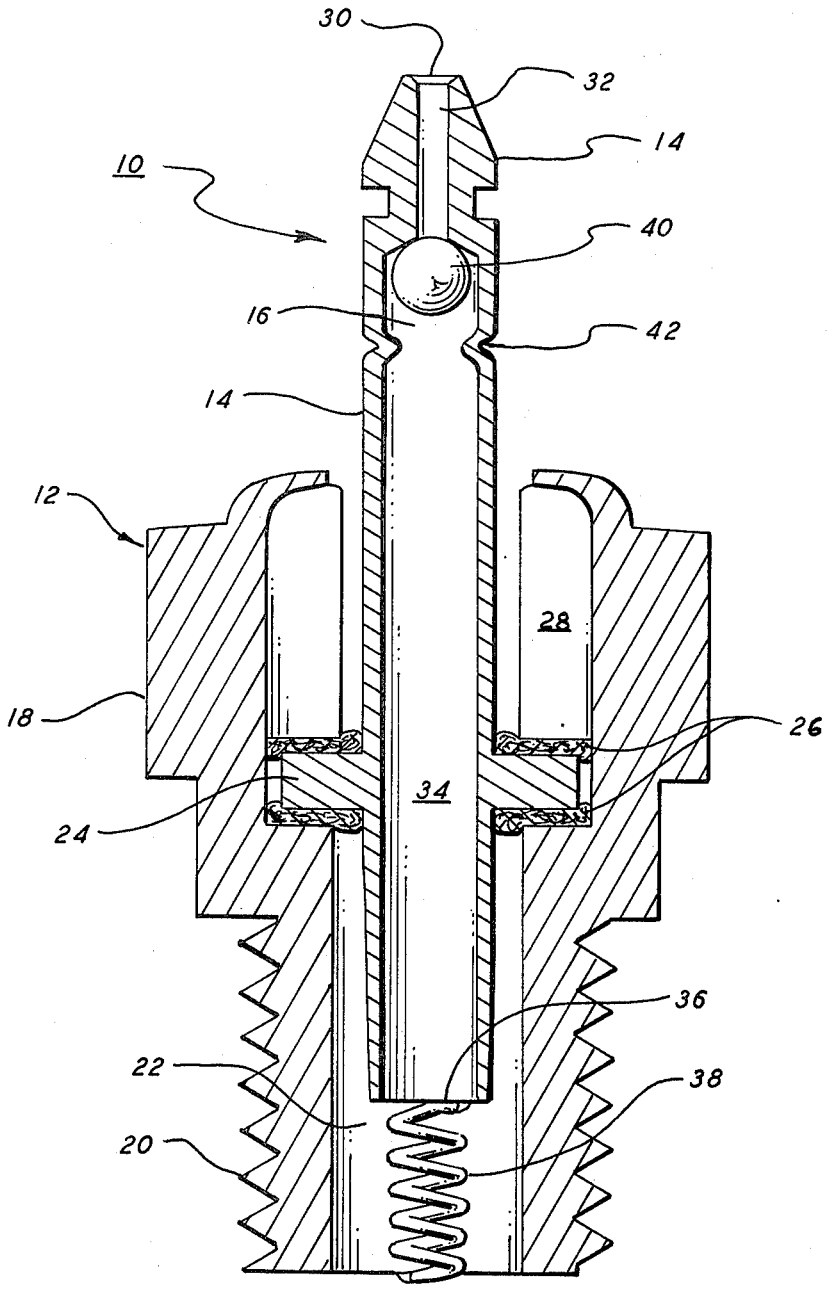
FIG. 2 is a vertical cross-sectional view of the primer valve in accordance with the preferred embodiment of the invention taken along line 2—2 of FIG. 1.

Referring specifically to FIGS. 1 and 2 of the drawings, the primer valve of the present invention is shown by the reference number 10 and comprises a glow plug 12 threadedly mounted on a standard two-cycle engine shown with the combustion chamber and related components identified to facitate the understanding of the invention. The glow plug is provided with a hollow center electrode 14 having direct access into the combustion chamber of the engine and provided with a one-way valve 16 integral therewith, as hereinafter described.

The glow plug 12 of a conventional type used with two-cycle engines for providing the necessary ignition is provided with a cylindrical housing 18 threaded at one end 20 and having an axial bore 22 in which the hollow center electrode 14 is mounted electrically isolated therefrom.

The center electrode 14 is provided with an integral circular flange 24 electrically separated from the cylindrical housing 18 by insulating and sealing gaskets 26. A spacer 28 maintains the center electrode in a fixed axial configuration relative to the cylindrical housing. The exposed end of the center electrode is formed with a primer opening 30 connected by an axial aperture 32 to a hollow electrode portion 34 having an inner open end 36. A heating element 38 is provided within the axial bore 22 with one end attached to the open end 36 of the electrode and the other end attached to the portion of the cylindrical housing 18 extending into the combustion chamber of the engine.

The one-way valve 16 consists of a ball check valve 40 axially movable within the hollow electrode 14 between the inner end of the axial aperture 32 and a ball retainer indent 42 provided on the electrode. In this manner, the inner end of the axial aperture forms the valve seat for the ball check valve. Further, the indent 42 is provided only in one or more portions of the periphery of the hollow electrode to permit fuel flow between the ball check valve and the inner surface of the hollow electrode during priming of the engine.

In the preferred embodiment 10, the ball check valve 40 and the hollow electrode are fabricated of steel, however, these components may be fabricated of any suitable materials compatible with the engine environment. For example, the ball check valve may be of a heat resistant polymer material, or the like. In addition, it is, of course, obvious that the ball check valve 40 of the preferred embodiment may be a needle type valve or of any other configuration to provide a one-way valve within the hollow electrode 14.

Figure 3:
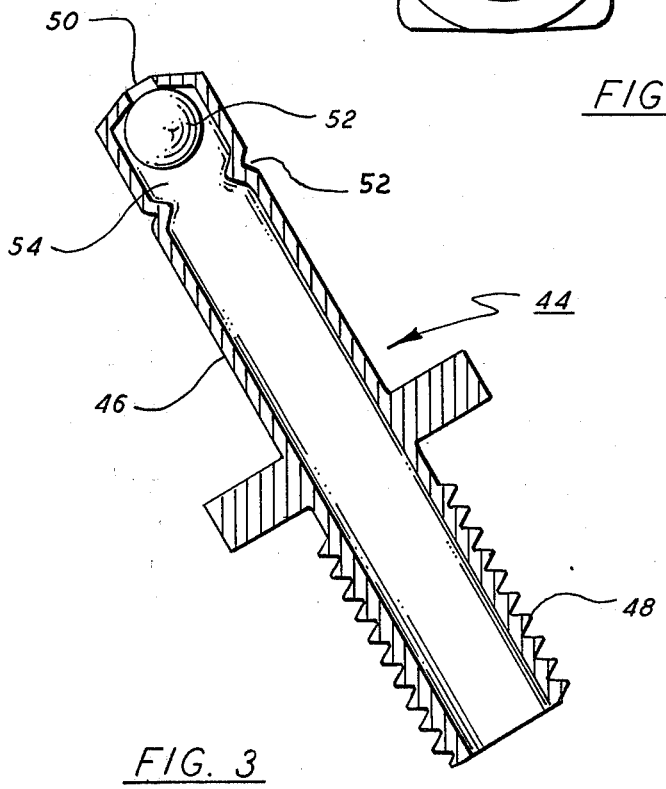
FIG. 3 is a vertical cross-sectional view of the primer valve in accordance with another embodiment of the invention.

FIG. 3 shows an embodiment of the invention, wherein a one-way valve 44 is provided with a cylindrical housing 46 threaded at one end 48 and having a primer opening 50 at the opposite end. A ball check valve 52 is provided within the cylindrical housing 46 adjacent to the primer opening and maintained within a valve chamber 54 by a ball retainer indent 56 in the cylindrical housing. The one-way valve 44 is adapted to be threaded into the cylinder head of the engine, for example, along the line 3—3 of FIG. 1, and used in conjunction with but spaced from a standard glow plug. The one-way valve 44 provides a means of priming the cylinder directly through an aperture that is automatically closed after priming by internal cylinder pressure.

In general, two-cycle model engines use glow plug ignition. Usual starting procedure includes priming the engine through the exhaust port. However, with present noise pollution controls, it is necessary to use a muffler on such engines; as a result, the exhaust port is inaccessible. The hereinbefore invention provides for direct priming through the glow plug or through the engine cylinder head using valve means that permits flow in one direction to provide easy starting in cold weather or warm with muffler in place.

In operation of the preferred embodiment 10, a small plastic squeeze bottle of fuel is pressed against the primer opening 30 and squeezed to send a small charge of fuel through the one-way valve 16 into the engine cylinder. Next, the engine is manually cranked and the compression pushes the ball check valve 40 against the axial aperture 32 to seal the aperture. When the engine fires and runs the internal pressure is always positive and maintains the ball check valve in place sealing the aperture 32.

Further, in the operation of a throttled two-cycle model engine, the temperature of the heating element 38, usually fabricated of platinum or alloy element, is easily maintained due to the large number of firing cycles per minute — 8,000 to 15,000 cycles per minute. As the engine rpm decreases, the heating element decreases proportionately to a point where the temperature is too low to fire the fuel and air mixture, and the engine stalls. In the preferred embodiment 10, the hollow electrode portion 34 decreases the cross-sectional area of the center electrode 14 by approximately 50% over that of standard glow plugs thereby reducing the rate of heat loss through the electrode and, in turn, reducing the heat required to maintain the heating element 38 at a sufficient temperature to support combustion.

In addition, the hollow electrode portion 34 forms a part of the combustion chamber. During engine operation combustion occurs within the hollow electrode heating the entire center electrode to provide a reservoir of hot gasses that flow over the heating element 38 as the cylinder pressure decreases during the power/exhaust cycle. In this manner, the heating element will be maintained at a sufficient temperature to insure combustion at low temperatures and reduced idling R.P.M. and thereby provide idle reliability in a two-cycle model engine. Specifically, the reduced idling R.P.M. results in lower landing approach speeds and safer model landings. Thus, improved idle reliability reduces the frequency of power-off landings and the possible destruction of expensive models.

While the present invention has been described in preferred embodiments, it will be obvious to those skilled in the art that various modifications can be made therein within the scope of the invention and it is intended that the appended claims cover all such modifications.

What is claimed is:

1. A primer valve for a two cycle engine attached to an accessible portion thereof and independent of the mounting configuration of the engine comprising a glow plug having a cylindrical housing threadedly secured into the cylinder head of the engine and provided with a hollow center electrode electrically isolated therefrom, said electrode provided with an integral circular flange to maintain it in a fixed axial configuration relative to said housing and having an exposed end formed with a primer opening, a hollow electrode portion axially spaced from said primer opening and having direct access to the engine cylinder, an axial aperture operatively connecting said primer opening and said hollow electrode portion and having an inner end forming a valve seat, a number of indent portions provided on the inner surfaces of said hollow electrode and axially spaced from said valve seat, a ball check valve freely movable within said hollow electrode between said valve seat and said indent portions to operatively seal said inner end in response to the continuous positive internal pressure of the operating engine while permitting fuel flow through said indent portions during priming of the engine.

2. A primer valve for a two cycle engine comprising a glow plug threadedly secured into the cylinder head of the engine and provided with a hollow center electrode having a primer opening at one end and axially spaced therefrom said hollow electrode portion having direct access to the engine cylinder, an axial aperture operatively connecting said primer opening and said hollow electrode portion and having an inner end forming a valve seat, ball retainer indent portions formed on the inner surface of said hollow electrode, a ball check valve axially and freely movable within said hollow electrode between said valve seat and said indent portions to operatively seal said inner end in response to the continuous positive internal pressure of the operating engine but permitting fuel flow between said ball check valve and said indent portions during priming of the engine.

* * * * *